US012405030B2

(12) United States Patent
Cabrera et al.

(10) Patent No.: US 12,405,030 B2
(45) Date of Patent: Sep. 2, 2025

(54) TOP FIRED OUTDOOR GAS HEAT EXCHANGER

(71) Applicant: Johnson Controls Tyco IP Holdings LLP, Milwaukee, WI (US)

(72) Inventors: Robert Edward Cabrera, Wichita, KS (US); Madhuka Manuranga Jayarathne, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 408 days.

(21) Appl. No.: 17/534,192

(22) Filed: Nov. 23, 2021

(65) Prior Publication Data

US 2023/0160605 A1 May 25, 2023

(51) Int. Cl.
*F24H 8/00* (2022.01)
*F24H 3/08* (2022.01)
*F24H 9/1881* (2022.01)

(52) U.S. Cl.
CPC ..... *F24H 8/006* (2013.01); *F24H 3/087* (2013.01); *F24H 9/1881* (2013.01)

(58) Field of Classification Search
None
See application file for complete search history.

(56) References Cited

U.S. PATENT DOCUMENTS

| | | | | | |
|---|---|---|---|---|---|
| 5,775,318 | A * | 7/1998 | Haydock | F28F 9/26 | 126/110 R |
| 5,839,505 | A * | 11/1998 | Ludwig | F28F 1/06 | 165/DIG. 497 |
| 6,352,431 | B1 * | 3/2002 | Gatley, Jr. | F27D 9/00 | 126/110 A |
| 8,056,553 | B2 * | 11/2011 | Khan | F24H 3/087 | 126/110 R |
| 9,709,341 | B2 * | 7/2017 | Naruse | F28D 1/0477 | |
| 10,584,896 | B2 | 3/2020 | Wilson et al. | | |
| 10,753,687 | B2 * | 8/2020 | Plummer | F28D 7/087 | |
| 2002/0005275 | A1 * | 1/2002 | O'Donnell | F24H 9/0026 | 165/163 |
| 2005/0161209 | A1 * | 7/2005 | Havard, Jr. | F24H 3/087 | 165/177 |
| 2008/0029243 | A1 * | 2/2008 | O'Donnell | F28F 1/06 | 165/184 |
| 2022/0042716 | A1 * | 2/2022 | Kanagala | F28D 7/06 | |
| 2023/0330451 | A1 * | 10/2023 | Jones | A62B 23/02 | |

* cited by examiner

*Primary Examiner* — Jenna M Maroney
(74) *Attorney, Agent, or Firm* — Fletcher Yoder, PC

(57) ABSTRACT

A furnace for a heating, ventilation, and air conditioning (HVAC) unit includes a heat exchange tube configured to flow combustion products therethrough and place the combustion products in a heat exchange relationship with an air flow directed across the heat exchange tube. The furnace also includes a burner assembly fluidly coupled to a first port of the heat exchange tube and configured to generate the combustion products directed into the heat exchange tube via the first port, and a draft inducer blower fluidly coupled to a second port of the heat exchange tube and configured to draw the combustion products through the heat exchange tube. The burner assembly is higher in position than the draft inducer blower relative to a base of the HVAC unit.

20 Claims, 10 Drawing Sheets

TOP FIRED OUTDOOR GAS HEAT EXCHANGER

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and air conditioning (HVAC) systems are utilized to control environmental properties, such as temperature and humidity, for occupants of residential, commercial, and industrial environments. The HVAC systems may control the environmental properties through control of an air flow delivered to the environment. For example, an HVAC system may include several heat exchangers, such as a heat exchanger configured to place an air flow in a heat exchange relationship with a refrigerant of a vapor compression circuit (e.g., evaporator, condenser), a heat exchanger configured to place an air flow in a heat exchange relationship with combustion products (e.g., a furnace), or both. In general, the heat exchange relationship(s) may cause a change in pressures and/or temperatures of the air, the refrigerant, the combustion products, or any combination thereof. As the temperatures and/or pressures of the above-described fluids change, liquid condensate may be formed in or on the associated heat exchangers.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a furnace for a heating, ventilation, and air conditioning (HVAC) unit includes a heat exchange tube configured to flow combustion products therethrough and place the combustion products in a heat exchange relationship with an air flow directed across the heat exchange tube. The furnace also includes a burner assembly fluidly coupled to a first port of the heat exchange tube and configured to generate the combustion products directed into the heat exchange tube via the first port, and a draft inducer blower fluidly coupled to a second port of the heat exchange tube and configured to draw the combustion products through the heat exchange tube. The burner assembly is higher in position than the draft inducer blower relative to a base of the HVAC unit.

In another embodiment, a furnace for a heating, ventilation, and air conditioning (HVAC) system includes a panel comprising an inlet and an outlet, and a heat exchange tube fluidly coupled to the inlet and to the outlet on a first side of the panel. The heat exchange tube is configured to direct combustion products from the inlet to the outlet and place the combustion products in a heat exchange relationship with an air flow directed across the heat exchange tube along an air flow path through the furnace. The furnace also includes a burner assembly coupled to a second side of the panel at a first position along a vertical axis, and a draft inducer blower coupled to the second side of the panel at a second position along the vertical axis. The first position is above the second position along the vertical axis. The burner assembly is configured to generate the combustion products and direct the combustion products into the heat exchange tube via the inlet, the draft inducer blower is configured to draw the combustion products through the heat exchange tube towards the outlet.

In another embodiment, a furnace for a heating, ventilation, and air conditioning (HVAC) system includes a heat exchange tube having a first port configured to receive combustion products and a second port configured to discharge the combustion products. The heat exchange tube is configured to direct the combustion products from the first port to the second port. The furnace also includes a burner assembly fluidly coupled to the first port, and a draft inducer blower fluidly coupled to the second port. The burner assembly is configured to generate the combustion products and direct the combustion products into the heat exchange tube via the first port, and the draft inducer blower is configured to draw the combustion products through the heat exchange tube and remove the combustion products from the heat exchange tube via the second port. The first port is above the second port relative to gravity, and the heat exchange tube is configured to discharge liquid condensate from the heat exchange tube via the second port.

BRIEF DESCRIPTION OF THE DRAWINGS

Various aspects of this disclosure may be better understood upon reading the following detailed description and upon reference to the drawings in which.

DETAILED DESCRIPTION

Figure 1:
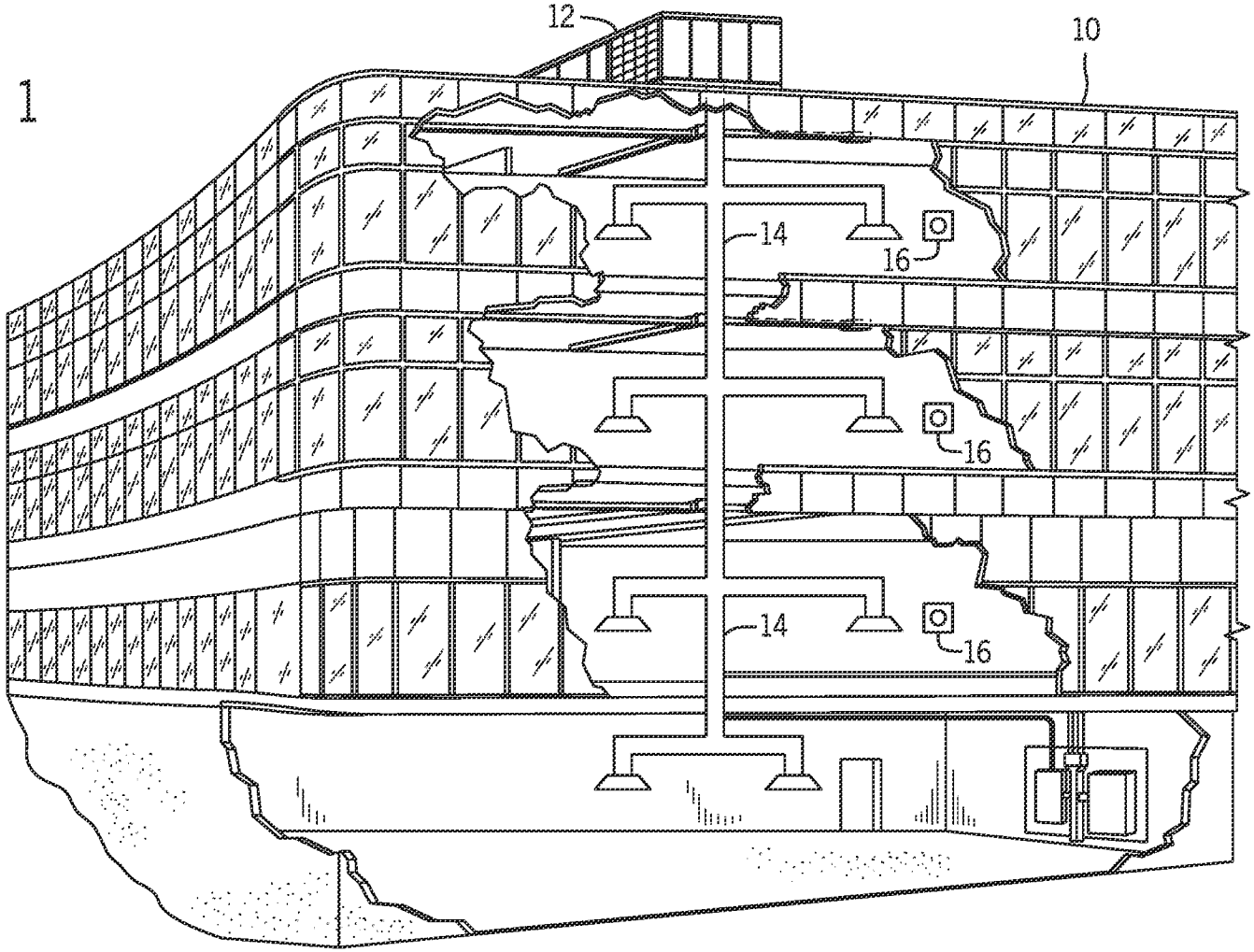
FIG. 1 is a perspective view of a building having an embodiment of a heating, ventilation, and air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heat exchanger for heating, ventilation, and air conditioning (HVAC) systems configured to increase the temperature of an air flow directed through the HVAC system. In some embodiments, the heat exchanger (e.g., furnace) may be disposed in a packaged outdoor unit or a rooftop unit configured to both heat and cool an air flow, such as a supply air flow that is conditioned and directed to a conditioned space (e.g., a building). For example, the furnace may include a heat exchanger having tubes that is configured to receive relatively hot combustion products (e.g., flue gas) generated via a burner assembly. The furnace may also include a draft inducer (e.g., draft inducer blower) configured to circulate the combustion products through the tubes of the heat exchanger. Further, the furnace may include a blower configured to direct the supply air flow across the tubes, thereby placing the supply air flow in a heat exchange relationship with the relatively hot combustion products to heat the supply air flow.

In some circumstances, liquid condensate may form in or on the above-described heat exchanger. For example, during a cooling mode of the HVAC system (e.g., when the furnace is in an inoperative mode or shut-off), relatively cool supply air flow may be directed across the tubes of the heat exchanger. The relatively cool supply air flow may cause air within the tubes of the heat exchanger (e.g., ambient air) to cool, thereby causing moisture contained within the air to condense. As the air within the tubes condenses, liquid condensate may form within the tubes. However, collection of condensate within the tubes may adversely affect the heat exchanger, and therefore it may be desirable to drain the condensate from the heat exchanger. Unfortunately, traditional heat exchangers (e.g., furnaces) may be configured in a manner that does not adequately allow the condensate to drain from the heat exchanger. For example, existing designs may cause condensate to flow via gravity to the burner assembly, which may lead to degradation, operating interruptions, and/or inefficiencies in the heat exchanger. That is, traditional heat exchanger configurations typically include a burner assembly connected to heat exchange tubes at a base (e.g., bottom side, near a drain outlet) of the heat exchanger and a draft inducer connected to the heat exchange tubes near a top side of the heat exchanger. In such a configuration, the burner assembly is susceptible to potential degradation from liquid or liquid condensate that may flow toward the burner assembly via gravity.

It is now recognized that improved heat exchanger configurations and related features are desired to limit an amount of liquid condensate that may reach the burner assembly, thereby limiting potential degradation and inefficiencies of a furnace. In accordance with the present techniques, the heat exchanger may be configured to enable a liquid (e.g., condensate) within the heat exchange tubes to flow towards a drain outlet at a base of the heat exchanger. For example, one or more segments of the tubes may be positioned at an angle relative to horizontal to enable drainage of liquid therein via gravity. A draft inducer may be fluidly connected to the heat exchange tubes at a base of the heat exchanger and proximate to the drain outlet of the heat exchanger. A burner assembly may also be fluidly connected to the heat exchange tubes at a position above (e.g., top-fired heat exchanger) the draft inducer relative to gravity (e.g., near the top of the heat exchanger), such that liquid condensate formed within the heat exchange tubes (e.g., via condensation) will be directed away from the burner assembly and towards the drain outlet via gravity. The term "top-fired heat exchanger" used herein may refer to a general configuration in which the burner assembly is connected to a first end or port of the heat exchange tubes at a first position, the draft inducer is connected to a second end or port of the heat exchange tubes at a second position, and the first position of the burner assembly is higher than the second position of the draft inducer, relative to gravity. Such a configuration may limit an amount of liquid condensate from reaching the burner assembly, thereby increasing efficiency and reducing a likelihood of degradation to certain aspects of the furnace.

As will be appreciated, the heat exchanger systems disclosed herein may be used in association with any of a variety of HVAC systems, including those in residential and commercial settings. For example, the heat exchanger systems may be utilized in a rooftop unit (RTU), a dedicated outdoor air system, or a split system. Non-limiting examples of systems that may use the heat exchanger system of the present disclosure are described herein with respect to FIGS. 1-4.

Turning now to the drawings, FIG. 1 illustrates a heating, ventilation, and air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
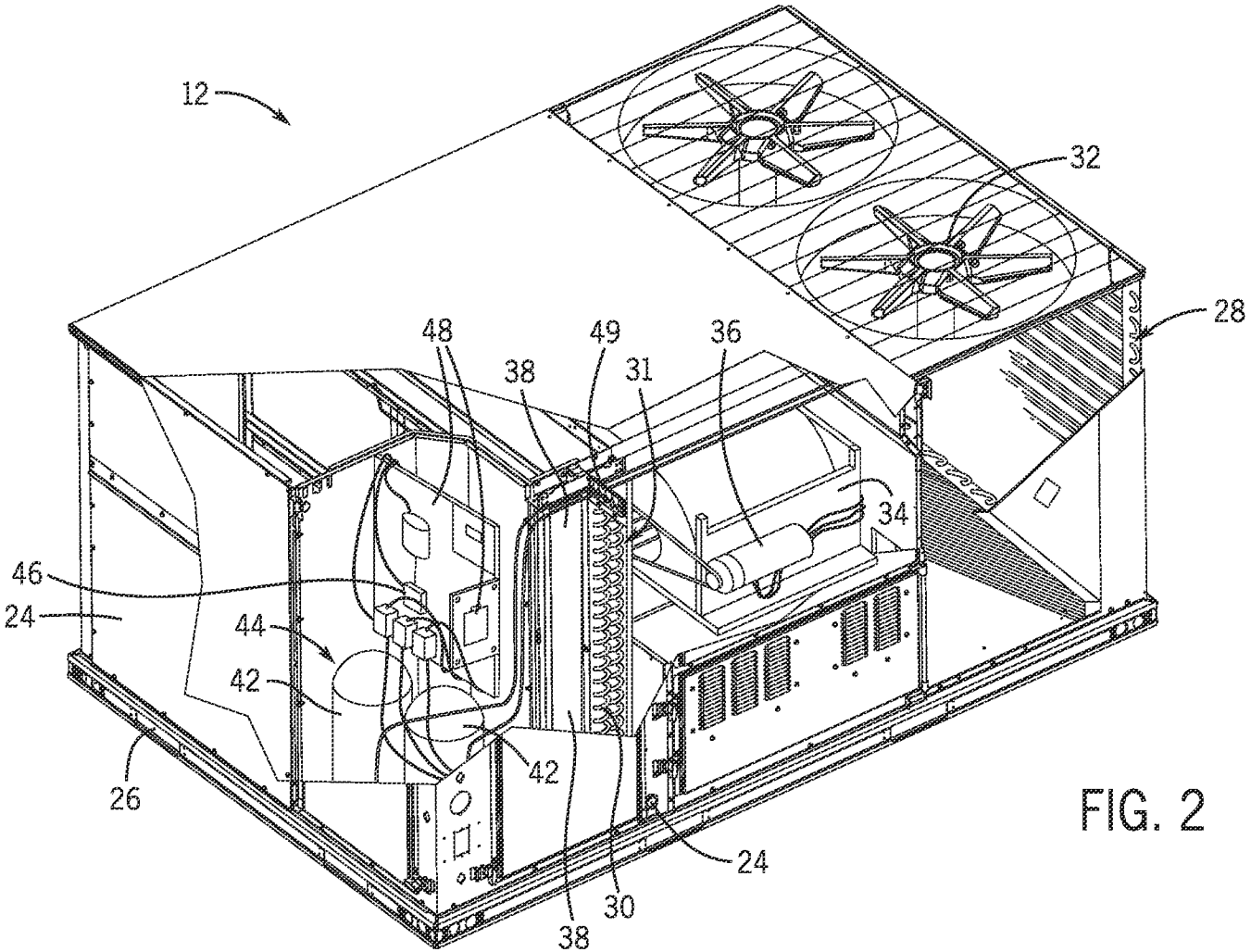
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
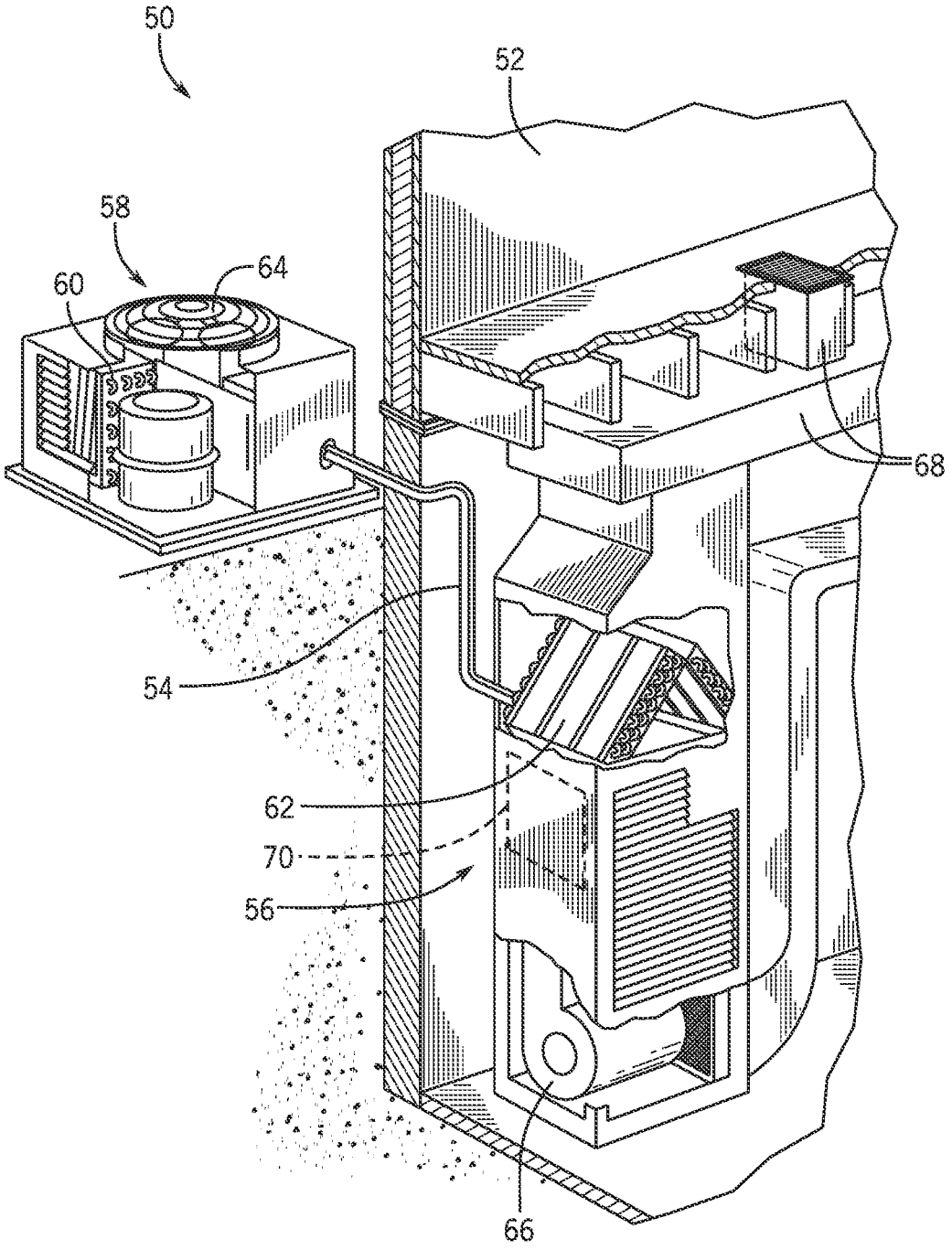
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
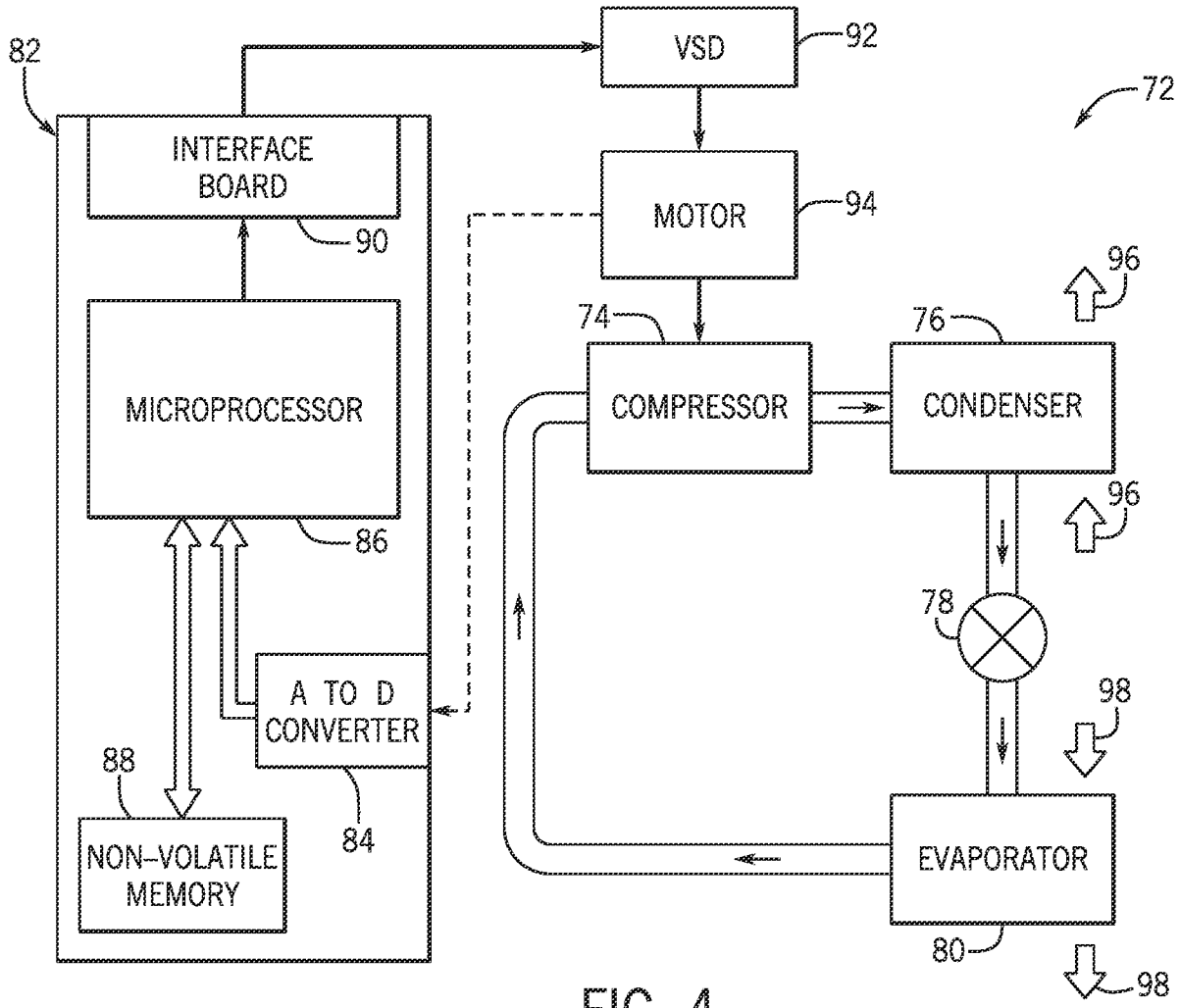
FIG. 4 is a schematic illustration of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, any of the systems illustrated in FIGS. 1-4 may include or operate in conjunction with a furnace in accordance with the present disclosure, such as the furnace system 70 of FIG. 3. For example, the furnace system 70 of FIG. 3 may generate combustion products, sometimes referred to as flue gas or exhaust gas, and then rout the combustion products through tubes (or coils) of the furnace system 70. During an operative mode (e.g., heating mode), a supply air flow may be forced across the tubes of the furnace system 70, for example by a fan or blower, such that the supply air flow is heated by the combustion products in the tubes of the furnace system 70 prior to delivery of the heated air flow to a conditioned space. Similarly, during a cooling mode (e.g., when the furnace is shut-off or inoperative), ambient or other air may remain in the tubes of the furnace, and a relatively cool supply air flow may be directed across the tubes. As the air within the tubes is cooled via heat exchange with the supply air flow, liquid condensate may form inside of the tubes of the furnace system 70.

In accordance with the present disclosure, a heat exchanger (e.g., a furnace) may be coupled to a heat source, such as a burner assembly (e.g., burner) that generates combustion products, to provide heat to a supply air flow directed across the heat exchanger via a supply air source (e.g., blower, fan). The heat exchanger may also be coupled to a draft inducer that directs (e.g., draws) the combustion products through one or more heat exchange tubes of the heat exchanger. The burner assembly may be fluidly connected to a first port of the heat exchange tubes at a first position proximate a top portion of the heat exchanger, and the draft inducer may be fluidly connected to a second port of the heat exchange tubes at a second position near a base portion of the heat exchanger. A drain outlet may also be located near the second end of the heat exchange tubes and may be configured to drain liquid condensate that forms within the heat exchange tubes during certain operations of the HVAC system, as described above. The first position (e.g., position of the burner assembly) may be higher relative to gravity than the second position (e.g., position of the draft inducer), thereby resulting in a top-fired heat exchanger configuration. By positioning the burner assembly at or near the top of the heat exchanger, liquid condensate formed within the heat exchange tubes may be directed away from the burner assembly at the first position and may instead be directed toward the drain outlet at the second position via the draft inducer and via gravity. In this manner, heat exchangers having the configuration discussed herein may be less susceptible to degradation, operating interruptions, and/or inefficiencies that may otherwise occur in traditional heat exchangers.

Figure 5:
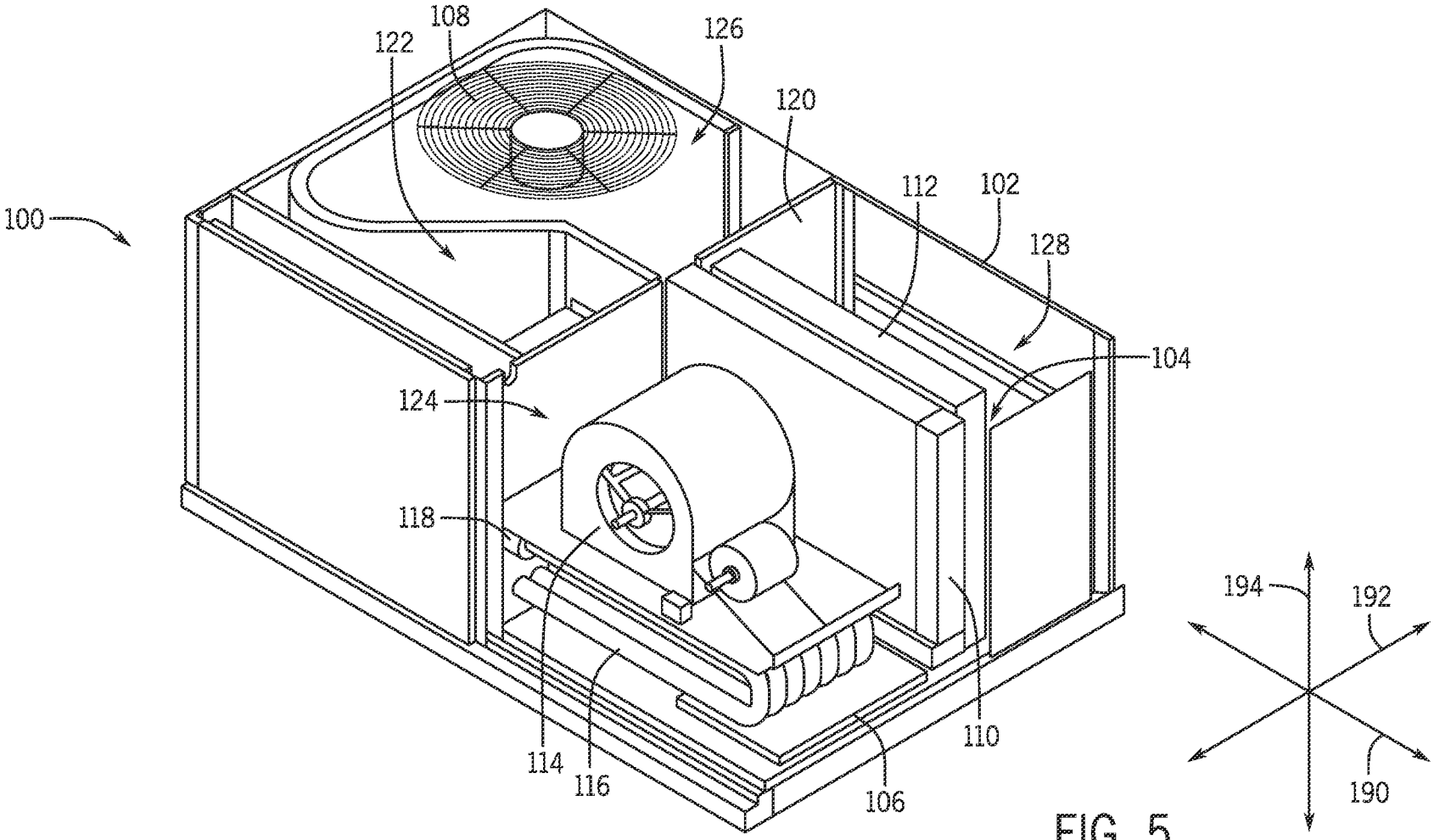
FIG. 5 is a perspective view of an embodiment of an HVAC unit, in accordance with an aspect of the present disclosure.

With this in mind, FIG. 5 is a perspective view of an embodiment of a packaged HVAC unit 100 that may employ one or more of the heat exchangers disclosed herein. In the illustrated embodiment, the packaged HVAC unit 100 includes multiple components enclosed within an internal volume of a housing 102 of the packaged HVAC unit 100. The packaged HVAC unit 100 may be configured to circulate air and therefore may include a return section 104 to receive an air flow, such as a return air flow from the building 10, and a supply section 106 to output an air flow, such as a supply air flow. As an example, the packaged HVAC unit 100 may be located in an outside environment, such as on a rooftop, and may be coupled to ductwork that directs air to and/or from rooms or other areas within a building, such as the building 10 of FIG. 1. The ductwork may couple to the return section 104 and the supply section 106. In this manner, the packaged HVAC unit 100 may circulate air in the building 10.

In addition to circulating air, the packaged HVAC unit 100 may change the temperature of the supply air flow directed therethrough. For example, the packaged HVAC unit 100 may include a refrigerant circuit that circulates a refrigerant therethrough, where the refrigerant circuit is in thermal communication with the air flow. The refrigerant may flow through a condenser 108, where the refrigerant may be cooled. FIG. 5 illustrates the condenser 108 as including a fan that may direct ambient air across the condenser 108 to remove heat from the refrigerant via convection, but in other embodiments, the condenser 108 may use another means of cooling the refrigerant, such as via a coolant. After being cooled, the refrigerant may then flow through an evaporator 110, where the refrigerant may absorb heat from the air flow (e.g., supply air flow) directed across the evaporator 110. Thus, the refrigerant may be heated, and the air flow may be cooled at the evaporator 110. After being heated at the evaporator 110, the refrigerant may return to the condenser 108 where it may once again be cooled. It should be appreciated that the refrigerant circuit may include other components, such as a compressor, expansion valve, and so forth, that enable conditioning of the supply air flow via the refrigerant.

The packaged HVAC unit 100 may also be configured to operate in a heating mode and a cooling mode. During operation of the heating mode, air may be received by the packaged HVAC unit 100 at the return section 104 to enter an air flow path. As mentioned, air (e.g., return air) may be received from ductwork that is connected to a building. However, in other embodiments, air received by the packaged HVAC unit 100 may be ambient air, such as from an outside environment. In certain embodiments, the supply air flow directed through the packaged HVAC unit 100 may include air from the return section 104 as well as ambient air. After the air flow enters the packaged HVAC unit 100, the air flow may pass across a filter 112. The filter 112 may remove particles from the air flow, such as dirt or other debris. The filter 112 may be a pleated filer, an electrostatic filter, a HEPA filter, or a fiber glass filter that traps the debris when the air flow passes through the filter 112. After being filtered, the air flow may be directed to the evaporator 110. As discussed above, at the evaporator 110, the air flow may be cooled by transferring heat to the refrigerant within the evaporator 110. In addition, cooling the air flow may also remove moisture from the air flow and thus, the packaged HVAC unit 100 may also dehumidify the air flow. Once cooled, the air flow may be directed through a blower 114, which may increase the velocity of the air flow and discharge the air flow as supply air via the supply section 106 of the packaged HVAC unit 100. Thereafter, the supply air flow may be circulated through the ductwork. In some embodiments, the blower 114 may also operate to draw air through the return section 104 and thereby function to both draw in and expel air.

In some modes of operation (e.g., a heating mode), prior to exiting the packaged HVAC unit 100, the air may be heated by a heat exchanger 116 (e.g., a furnace). By way of example, the heat exchanger 116 may be coupled to a heat source 118. In some embodiments, the heat exchanger 116 may be a gas heat exchanger and may be coupled to a gas burner (e.g., a burner assembly) that combusts a fuel (e.g., air-fuel mixture), such as acetylene, natural gas, propane, another gas, or any combination thereof to produce combustion products having an elevated temperature that are directed into the heat exchanger 116. When the air flow is directed across the heat exchanger 116, the air flow may absorb heat from the combustion products, thereby increasing the temperature of the air flow. Thereafter, the air flow may then exit the packaged HVAC unit 100 at a higher temperature compared to the air flow entering the packaged HVAC unit 100.

During a cooling mode of the packaged HVAC unit 100, the heat exchanger 116 may be inoperative (e.g., turned off). However, some of the combustion products generated during a previous heating mode may linger or remain within heat exchange tubes of the heat exchanger 116. Additionally or alternatively, when the heat exchanger 116 is not operating, another flow of air (e.g., ambient air) may nevertheless flow or reside in the heat exchange tubes of the heat exchanger 116. As a relatively cool air flow (e.g., supply air cooled by the evaporator 110) is directed across the heat exchange tubes, air within the heat exchange tubes may lose heat to the relatively cool air flow, thereby causing any moisture within the air to condense and form liquid condensate within the heat exchange tubes of the heat exchanger 116. To mitigate collection of the condensate within the heat exchange tubes, the heat exchanger 116 of the present disclosure is configured to enable removal of the liquid condensate from the heat exchange tubes while also mitigating contact between the condensate and other components of the heat exchanger 116 (e.g., the burner assembly). In this way, degradation, inefficiency, and/or other adverse effects that may otherwise be caused by the condensate is avoided. The features and aspects of the heat exchanger 116 are discussed in further detail below.

To separate various components within the packaged HVAC unit 100, the packaged HVAC unit 100 may include partitions 120 (e.g., panels, vestibule panels, dividers, separation plates, etc.). As an example, the partitions 120 may divide the internal volume defined by the housing 102 into a first volume 122, which may contain the heat source 118 (e.g., burner assembly) of the heat exchanger 116, a second volume 124 (e.g., supply air section) from the supply air flow may exit the packaged HVAC unit 100, a third volume 126 that contains the condenser 108, and a fourth volume 128 (e.g., return air section 104) configured to receive air flow directed into the packaged HVAC unit 100. Various components of the packaged HVAC unit 100 may also be oriented along a number of axes including a lateral axis 190, a longitudinal axis 192, and a vertical axis 194.

Figure 6:
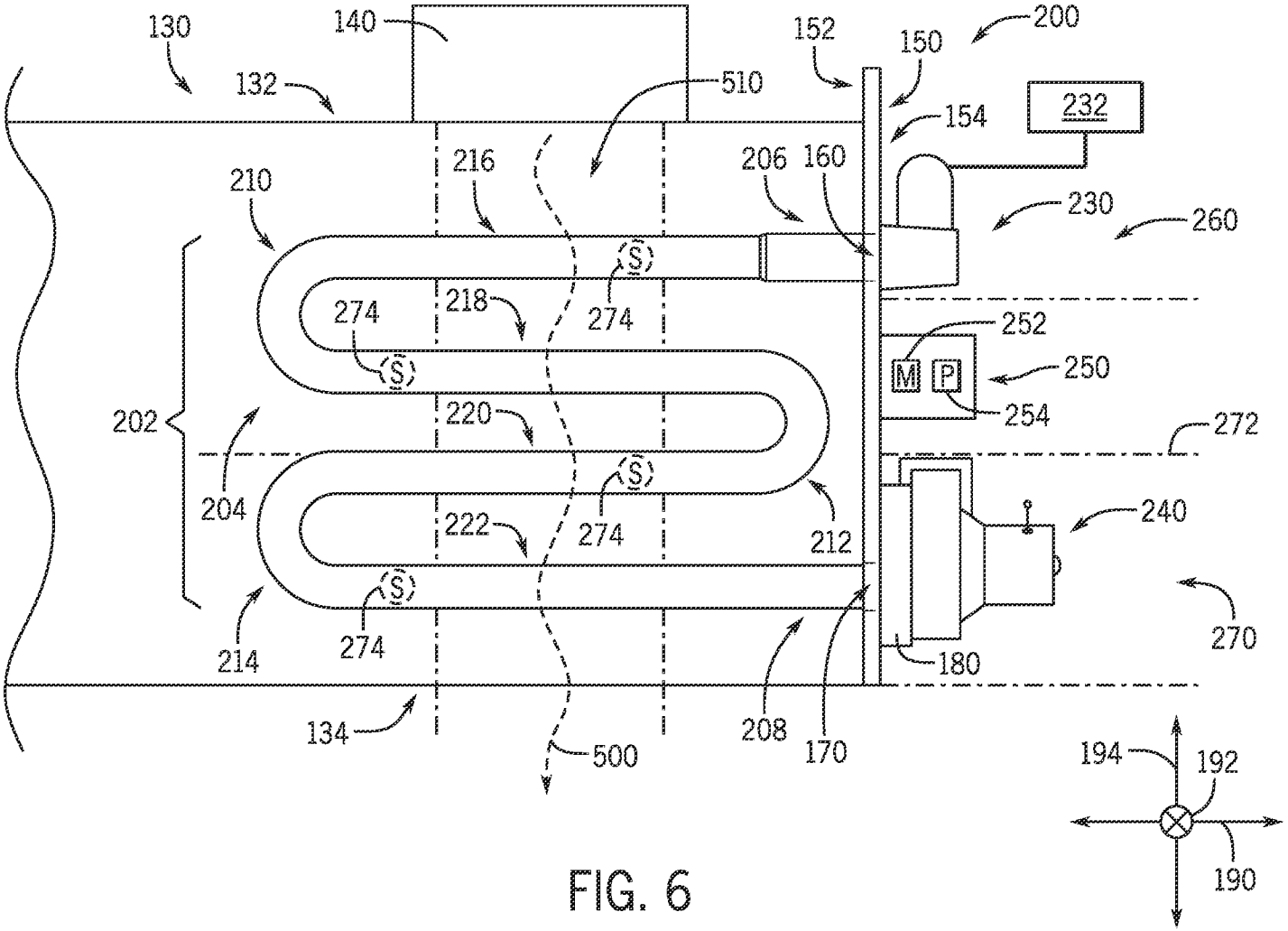
FIG. 6 is a side view of an embodiment of a furnace, in accordance with an aspect of the present disclosure.

FIG. 6 is side view of an embodiment of a furnace 200 (e.g., heat exchanger) that can be used with or in any of the systems of FIGS. 1-5 or any other suitable HVAC system. For example, the furnace 200 of FIG. 6 may correspond to the heat exchanger 116 in FIG. 5. The furnace 200 may be disposed within a housing 130 (e.g., support structure), such as a section of the housing 102 of FIG. 5, a section of an air handler, a standalone housing, or any other suitable support structure. The housing 130 may include a first side 132 (e.g., top side, panel, etc.) and a base 134 (e.g., bottom side, panel, etc.). However, in some embodiments, the furnace 200 may not include the first side 132 and/or the base 134 of the housing 130.

A blower 140 (e.g., fan) may be coupled or secured to the first side 132 of the housing 130 and may be configured to generate or direct an air flow 500 along an air flow path 510 of the furnace 200. The blower 140 may correspond to the blower 114 in FIG. 5. The housing 130 may also include a vestibule panel 150 (e.g., side panel, panel, etc.), which may correspond to one of the partitions 120 of FIG. 5. In the embodiment illustrated in FIG. 6, the furnace 200 includes a heat exchange section 202 coupled to the vestibule panel 150. The heat exchange section 202 may include one or more heat exchange tubes 204, with each heat exchange tube 204 having a first port 206 (e.g., first end, top end, upper end, inlet, upstream end, etc.) and a second port 208 (e.g., second end, bottom end, lower end, outlet, downstream end, etc.) that are each coupled to the vestibule panel 150. The heat exchange tube 204 may extend from the first port 206 to the second port 208 in any suitable configuration, geometry, or arrangement. In the illustrated embodiment, the heat exchange tube 204 also includes a first bend 210 (e.g., top bend, upstream bend), a second bend 212 (e.g., middle bend, midstream bend), and a third bend 214 (e.g., bottom bend, downstream bend). The heat exchange tube 204 extends between each of the first port 206, second port 208, first bend 210, second bend 212, and third bend 214. In this manner, the heat exchange tube 204 defines multiple passes (e.g., tube passes, tube segments, conduit segments, etc.) of the heat exchange tube 204 through which combustion products are directed and across which the air flow 500 is directed. More specifically, the heat exchange tube 204 defines a first pass 216 extending between the first port 206 and the first bend 210, a second pass 218 extending between the first bend 210 and the second bend 212, a third pass 220 extending between the second bend 212 and the third bend 214, and a fourth pass 222 extending between the third bend 214 and the second port 208. In some embodiments, one or more of the passes 216, 218, 220, 222 may extend in a direction along the lateral axis 190 (e.g., in a horizontal direction, along a horizontal axis 272). In other embodiments, one or more of the passes 216, 218, 220, 22 may extend at an angle relative to the horizontal axis 272, as described in greater detail below.

The first port 206 may be coupled or secured to a first side 152 of the vestibule panel 150 proximate an inlet 160 (e.g., passage, hole, aperture, opening, channel) formed in the vestibule panel 150, and the second port 208 may be coupled to the first side 152 of the vestibule panel 150 proximate an outlet 170 (e.g., passage, hole, aperture, opening, channel) formed in the vestibule panel 150. The first and second ports 206, 208 may be coupled to the inlet 160, and outlet 170, respectively, via a swedging process or technique (e.g., expanding the first port 206 of the heat exchange tube 204 with the first port 206 positioned within the inlet 160 of the vestibule panel 150), welding, brazing, or any other mechanical fastening technique. Each of the passes 216, 218, 220, and 222 may be configured to extend crosswise relative to a direction of the air flow 500 along the flow path 510, as described in greater detail below. It should be understood that each of the features of the heat exchange tube 204 described above may be fluidly coupled to one another to enable flow of fluids (e.g., combustion products, liquid condensate) through the heat exchange tube 204 towards the outlet 170, as described in greater detail below. Further, in some embodiments, the heat exchange section 202 may include one or more heat exchange tubes 204 having additional features, alternative features, fewer or more bends, fewer or more passes, and so forth, based on selected characteristics, implementations, and/or operating parameters of the furnace 200. Further still, the heat exchange tubes 204 have different orientations (e.g., offset, aligned relative to one another) to facilitate various tube configurations that may reduce an overall size, height, and/or footprint of the furnace 200.

As discussed herein, the furnace 200 may also include a burner assembly 230 (e.g., combustor, heating element, burner system) configured to ignite a mixture of fuel and oxidant (e.g., air-fuel mixture) to generate combustion products. For example, the burner assembly 230 may be fluidly connected to a fuel source 232 and may also be fluidly coupled to the inlet 160 on a second side 154 of the vestibule panel 150. The burner assembly 230 may include one or more burners (e.g., premix burners) configured to ignite the mixture of fuel and oxidant to generate the combustion products, which are then directed through the inlet 160 and into the first port 206 of the heat exchange tube 204 via the first port 206 fluidly coupled to the inlet 160. That is, the burner assembly 230 and the first port 206 may be in fluid communication, such that the combustion products may generally travel from the burner assembly 230, through the inlet 160, through the first port 206, through the first, second, third, and fourth passes 216, 218, 220, and 222, and towards the second port 208 of the heat exchange tube 204. The second port 208 of the heat exchange tube 204 may be fluidly coupled to the outlet 170, thereby enabling the combustion products to pass through the second port 208 and into the outlet 170.

From the outlet 170, the combustion products may be removed from the system (e.g., via an exhaust conduit). To this end, the furnace 200 may also include a draft inducer 240 (e.g., draft inducer blower, draft blower, draft fan, inducer fan) fluidly coupled to the outlet 170 on the second side 154 of the vestibule panel 150. The draft inducer 240 is configured to facilitate flow of the combustion products through the heat exchange tube 204. That is, the draft inducer 240 may be fluidly coupled to the second port 208 via the outlet 170 and may be configured to draw the combustion products through the heat exchange tube 204. When operation of the furnace 200 is initiated to heat the air flow 500 (e.g., upon receipt of a call for heating), the draft inducer 240 may be operated prior to operation of the burner assembly 230 (e.g., 30 seconds before, a predetermined time period before, etc.), thereby removing any air or other gaseous compounds that may be present within the heat exchange tube 204 (e.g., via a suction air flow generated by the draft inducer 240). The draft inducer 240 may also be coupled to an exhaust conduit (not shown) which may be configured to direct combustion gases, air, and/or other gaseous compound out of the furnace 200 (e.g., the HVAC system having the furnace 200), as described in greater detail below.

As discussed above, the burner assembly 230 may be coupled or secured to the vestibule panel 150 at the inlet 160 of the vestibule panel 150, and the draft inducer 240 may be coupled or secured to the vestibule panel 150 at the outlet 170 of the vestibule panel 150. The burner assembly 230 and the draft inducer 240 may be secured via fasteners, brackets, pins, screws, or any other suitable mechanical fastening technique. As illustrated, the inlet 160 is located above (e.g., vertically above) the outlet 170 relative to the base 134 of the furnace 200 (e.g., relative to gravity, relative to the vertical axis 194, etc.). Thus, when installed and coupled to the vestibule panel 150, the burner assembly 230 is located at a top portion 260 of the furnace 200, and the draft inducer is located at a bottom portion 270 of the furnace 200. That is, the burner assembly 230 is higher in position than the draft inducer 240 relative to the base 134 of the furnace 200 (e.g., relative to gravity, relative to the vertical axis 194). This configuration (e.g., top-fired configuration, top-burner configuration) limits, reduces, and/or prevents the potential of liquid and/or liquid condensate that may form within the heat exchanger tube 204 from flowing toward the burner assembly 230, as described in greater detail below.

As previously described, operation of the furnace 200 may cause condensate to form within the heat exchange tube 204 as the air flow 500 travels across the heat exchange tube 204 along the flow path 510, such as during a cooling mode of operation when the furnace 200 is not operating to heat the air flow 500. As the liquid condensate forms within the heat exchange tube 204, the liquid condensate may be directed away from the burner assembly 230 and towards the outlet 170, such as via force of gravity. In some embodiments, each of the passes 216, 218, 220, and 220 may generally extend along the lateral axis 190 and may be disposed at an angle relative to a horizontal axis 272 (e.g., a horizontal direction), such that condensate formed within the heat exchange tube 204 may directed away from the top portion 260 of the furnace 200 and towards the bottom portion 270 of the furnace 200 via gravity. The liquid condensate may flow through one or more of the passes 216, 218, 220, and 222 and along one or more of the bends 210, 212, 214 towards the second port 208 of the heat exchange tube 204 that is in fluid communication with the outlet 170. Liquid condensate that reaches the outlet 170 may then be discharged from the furnace 200 via a drain (e.g., drain outlet), a conduit, or any suitable discharge flow path fluidly coupled to the outlet 170. In some embodiments, a gasket 180 (e.g., paper gasket) may be positioned between the outlet 170 of the vestibule panel 150 and the draft inducer 240. The gasket 180 may surround the second port 208 of the heat exchange tube 204, may have an opening formed therein that is aligned with the second port 208, and may extend from the outlet 170 (e.g., in a horizontal direction along the horizontal axis 272) away from the vestibule panel 150. The gasket 180 may be configured to facilitate drainage of the liquid condensate by providing clearance for the liquid condensate to drain out of the heat exchange tube 204 before reaching the draft inducer 240. That is, the gasket 180 may be composed of a porous material, thereby enabling liquid condensate to drain through the gasket 180 and out of the furnace 200 before reaching the draft inducer 240. It should be noted that various aspects of the furnace 200 may be manufactured, configured, and/or arranged to block or reduce an undesirable impact of the liquid condensate on the furnace 200 that may otherwise be caused by contact with the liquid condensate. By way of example, components of the heat exchange section 202, such as the heat exchange tube 204, the inlet 160, the outlet 170, the gasket 180, and the vestibule panel 150 may be made of stainless steel, chromium, and/or other suitable (e.g., corrosion resistant) material to reduce undesirable effects of the liquid condensate on the structural integrity and/or performance of the components.

The furnace 200 may also include a controller 250 configured to control operation of the burner assembly 230 and the draft inducer 240, such as based on an operating mode of the furnace 200. The controller 250 may be coupled to the vestibule panel 150 via welding, fasteners, screws, or other suitable technique. During operation, the controller 250 may receive a signal indicative of a call for operation in the cooling mode, and in response, the controller 250 may operate to shut-off or power down the burner assembly 230 and the draft inducer 240 such that combustion products are no longer generated and circulated through the heat exchange tubes 204. At a different time, the controller may receive a signal indicative of a call for operation in the heating mode, and in response, the controller 250 may operate to activate or power on the draft inducer 240 and the burner assembly 230 (e.g., sequentially, power on the draft inducer 240 prior to powering on the burner assembly 230, etc.) such that combustion products may be generated and circulated through the heat exchange tube 204 to enable heating of the air flow 500 directed across the heat exchange tube 204 along the air flow path 510.

In some circumstances, the controller 250 may be operate to activate the draft inducer 240 without activating the burner assembly 230. For example, a presence of liquid condensate within the heat exchange tube 204 may be detected via one or more sensors 274 (e.g., a liquid sensor, humidity sensor, condensate sensor, etc. fluidly coupled to and/or disposed within the heat exchanger tube 204 and communicatively coupled to the controller 250). Based on detection of the presence of liquid condensate, the draft inducer 240 may be activated to draw an air flow through the heat exchange tube 204 to motivate the liquid condensate towards the second port 208 and away from the burner assembly 230. To facilitate control of the components of the furnace 200, the controller 250 may include a memory 252 with instructions stored thereon for controlling operation the furnace 200 and components of the furnace 200, and processing circuitry 254 configured to execute such instructions. For example, the processing circuitry 254 may include one or more application specific integrated circuits (ASICs), one or more field programmable gate arrays (FPGAs), one or more general purpose processors, or any combination thereof. Additionally, the memory 252 may include a non-transitory computer-readable medium that may include volatile memory, such as random-access memory (RAM), and/or non-volatile memory, such as read-only memory (ROM), optical drives, hard disc drives, optical drives, solid-state drives or any other suitable non-transitory computer-readable medium storing instructions that, when executed by the processing circuitry 254, may control operation of the furnace 200. Although FIG. 6 illustrates the controller 250 as being coupled to the vestibule panel 150, in some embodiments, the controller 250 may be disposed elsewhere, such as remotely relative to the furnace 200.

Figure 7:
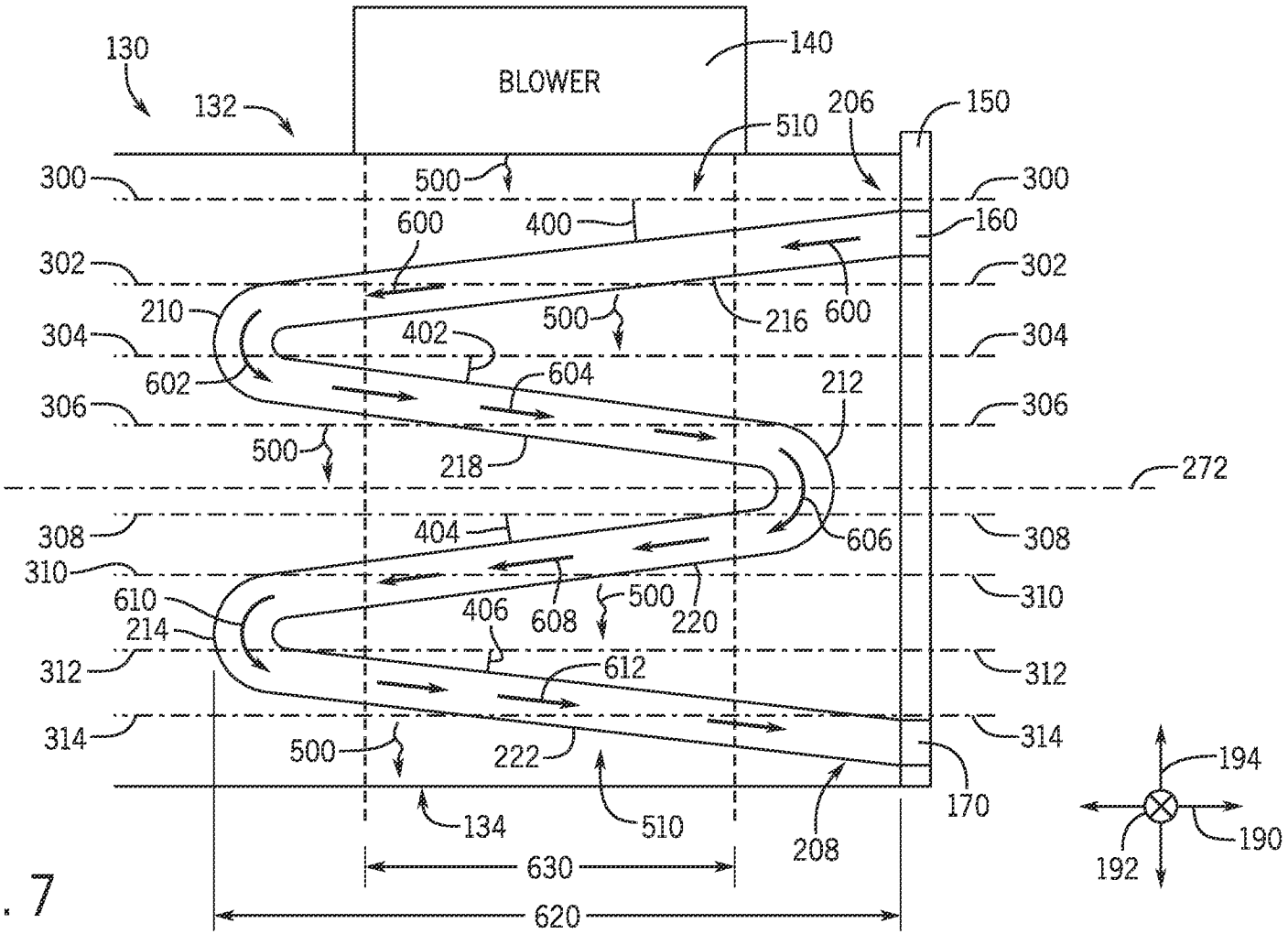
FIG. 7 is a schematic side view of an embodiment of a furnace, illustrating flow of liquid condensate within the furnace, in accordance with an aspect of the present disclosure.

FIG. 7 is a schematic side view of an embodiment of the furnace 200, illustrating various flow directions (e.g., flow paths) of liquid (e.g., liquid condensate) that may form within the heat exchange tube 204, such as in the manners described above. As illustrated, each of the passes 216, 218, 220, 222 extends at least partially in a direction of the lateral axis 190 and generally crosswise to the air flow path 510 (e.g., crosswise to the vertical axis 194) through which the air flow 500 is directed across the heat exchange tube 204. For example, one or more of the passes 216, 218, 220, and 222 (e.g., passes 216, 222) of the heat exchange tube 204 may extend a length 620 (e.g., width, distance) from the vestibule panel 150. However, some of the passes 216, 218, 220, and 222 (e.g., passes 218, 220) may extend a length less than the length 620. In some embodiments, the length 620 may be greater than a width 630 of the air flow path 510, such that the air flow 500 directed along the air flow path 510 may contact each of the passes 216, 218, 220, 222 as the air flow 500 flows through the air flow path 510. When air (e.g., ambient air) within the heat exchange tube 204 is cooled via a relatively cool supply air flow (e.g., air flow 500) directed along the air flow path 510 across the heat exchange tube 204, such as during non-operation of the furnace 200, moisture within the air inside the heat exchange tube 204 may condense, thereby forming liquid condensate within the heat exchange tube 204. As mentioned above, one or more of the passes 216, 218, 220, and 222 may be disposed at an angle relative to a horizontal axis 272 such that liquid condensate formed within the passes 216, 218, 220, and 222 may be directed via gravity, through the heat exchange tube 204 towards the outlet 170 and the gasket 180. Additionally, in some embodiments, one or more of the passes 216, 218, 220, and 222 may extend in a direction along the lateral axis 190 (e.g., a horizontal direction, along the horizontal axis 272).

For example, the first port 206 may be secured to the inlet 160 (e.g., passage, hole, aperture, opening, channel) at a first position 300 (e.g., first location along the vertical axis 194). The first pass 216 may extend from the first port 206 to the first bend 210 at a first angle 400 (e.g., downward angle) relative to the horizontal axis 272, such that liquid condensate formed within the first port 206 and/or the first pass 216 may be directed along a first flow path 600 of the heat exchange tube 204 towards the first bend 210 via gravity. That is, the first bend 210 may be disposed at a second position 302 (e.g., second location along the vertical axis 194), which is lower relative to gravity than the first position 300 of the first port 206. Thus, condensate formed within the first port 206 and/or the first pass 216 may travel from the first position 300 to the second position 302 along the first flow path 600 via gravity. Upon reaching the first bend 210, liquid condensate may fall (e.g., via gravity) along a second flow path 602 of the heat exchange tube 204 towards the second pass 218. The second pass 218 may be fluidly coupled to the first bend 210 at a third position 304 (e.g., third location along the vertical axis 194). As shown in the illustrated embodiment, the third position 304 is lower than the second position 302 relative to gravity such that condensate traveling through the first bend 210 falls along the second flow path 602 and into the second pass 218.

The second pass 218 may extend from the first bend 210 to the second bend 212 at a second angle 402 (e.g., downward angle) relative to the horizontal axis 272, such that liquid condensate within the second pass 218 may be directed along a third flow path 604 of the heat exchange tube 204 towards the second bend 212 via gravity. That is, the second bend 212 may be disposed at a fourth position 306 (e.g., fourth location along the vertical axis 194), which is lower relative to gravity than the third position 304. Thus, condensate reaching the second pass 218 may travel from the third position 304 to the fourth position 306 along the third flow path 604 via gravity. Upon reaching the second bend 212, liquid condensate may fall via gravity along a fourth flow path 606 of the heat exchange tube 204 towards the third pass 220. The third pass 220 may be fluidly coupled to the second bend 212 at a fifth position 308 (e.g., fifth location along the vertical axis 194). As shown in the illustrated embodiment, the fifth position 308 is lower than the fourth position 306 relative to gravity such that condensate traveling through the second bend 212 falls along the fourth flow path 606 and into the third pass 220.

The third pass 220 may extend from the second bend 212 to the third bend 214 at a third angle 404 (e.g., downward angle) relative to the horizontal axis 272, such that liquid condensate within the third pass 220 may be directed along a fifth flow path 608 of the heat exchange tube 204 towards the third bend 214 via gravity. That is, the third bend 214 may be disposed at a sixth position 310 (e.g., sixth location along the vertical axis 194) which is lower relative to gravity than the fifth position 308. Thus, condensate reaching the third pass 220 may travel from the fifth position 308 to the sixth position 310 along the fifth flow path 608 via gravity. Upon reaching the third bend 214, liquid condensate may fall via gravity along a sixth flow path 610 of the heat exchange tube 204 towards the fourth pass 222. The fourth pass 222 may be fluidly coupled to the third bend 214 at a seventh position 312 (e.g., seventh location along the vertical axis 194). As shown in the illustrated embodiment, the seventh position 312 is lower than the sixth position 310 relative to gravity such that condensate traveling through the third bend 214 falls along the sixth flow path 610 and into the fourth pass 222.

The fourth pass 222 may extend from the third bend 214 to the second port 208 at a fourth angle 406 (e.g., downward angle) relative to the horizontal axis 272, such that liquid condensate within the fourth pass 222 may be directed along a seventh flow path 612 of the heat exchange tube 204 towards the second port 208 via gravity. That is, the second port 208 may be disposed at an eighth position 314 (e.g., eight location along the vertical axis 194) which is lower relative to gravity than the seventh position 312. Thus, condensate reaching the fourth pass 222 may travel from the seventh position 312 to the eighth position 314 along the seventh flow path 612 via gravity. As discussed above, the embodiments included herein should not be considered limiting and other embodiments of the furnace 200 may include fewer or more passes, bends and heat exchange tubes as desired based on various design considerations of the furnace 200. In the manner described above, the furnace 200 including the features described herein enables drainage and removal of liquid condensate from the furnace while also directing the liquid condensate away from the burner assembly 230, thereby avoiding undesirable contact between liquid condensate and the burner assembly 230 and increasing efficiency and longevity of the burner assembly 230.

It should be noted that in some embodiments, one or more of the passes 216, 218, 220, and 222 may not extend at an angle relative to the horizontal axis 272 and instead may generally extend in a direction along the lateral axis 190 (e.g., in a horizontal direction along the horizontal axis 272 as illustrated in FIG. 6). That is, each heat exchange tube 204 may include one or more passes 216, 218, 220, 222 that extend at an angle relative to the horizontal axis 272 across the flow path 510, one or more passes 216, 218, 220, 222 that extend along the horizontal axis 272 (e.g., in a horizontal direction) across the flow path 510, or any combination thereof.

Figure 8:
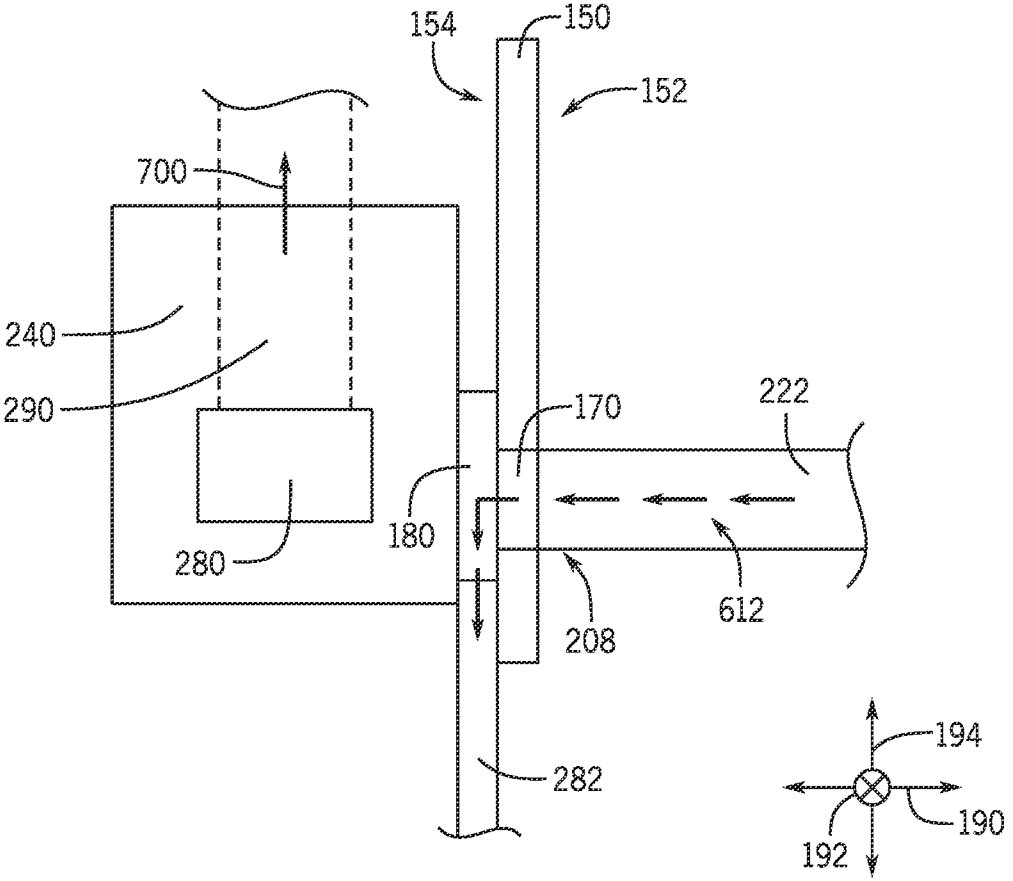
FIG. 8 is an schematic side view of an embodiment of a draft inducer of a furnace, in accordance with an aspect of the present disclosure.

FIG. 8 is a schematic side view of an embodiment of a portion of the furnace 200, illustrating the draft inducer 240 and the gasket 180 configured to facilitate removal of liquid condensate from the furnace 200. The gasket 180 may be disposed on the second side 154 of the vestibule panel 150 between the draft inducer 240 and the outlet 170 (e.g., passage, channel, hole, aperture, opening). As described above, liquid condensate that reaches the fourth pass 222 may travel along the seventh flow path 612 of the heat exchange tube 204 towards the second port 208, the outlet 170, and the gasket 180. The gasket 180 may be disposed around (e.g., circumferentially around) the outlet 170 and around the port 208 and may extend to a drain outlet 282. The gasket 180 may provide a channel, flow path, or other guide extending from the port 208, through the outlet 170, and to the drain outlet 282 such that liquid condensate directed along the seventh flow path 612 may flow from the outlet 170 and pass through or along the gasket 180 to be discharged from the furnace 200. In some embodiments, the gasket 180 may be composed of a porous material, thereby enabling liquid condensate to pass through the gasket 180 and towards the drain outlet 282 to be discharged from the furnace 200.

During an operative mode (e.g., heating mode), the draft inducer 240 may be configured to discharge combustion products circulated through the heat exchange tube 204 via an exhaust outlet 280 (e.g., outlet port, discharge port), which may be fluidly coupled to the draft inducer 240, such as via a panel (e.g., side panel) of the packaged HVAC unit 100 of FIG. 5. In some embodiments, the exhaust outlet 280 may be fluidly coupled to a conduit 290 (e.g., vertical exhaust, exhaust conduit) configured to receive combustion products from the draft inducer 240 and direct flow of the combustion products in a direction 700 (e.g., vertical direction), as described in greater detail below, to discharge the combustion products from the furnace 200 and/or the packaged HVAC unit 100.

Figure 9:
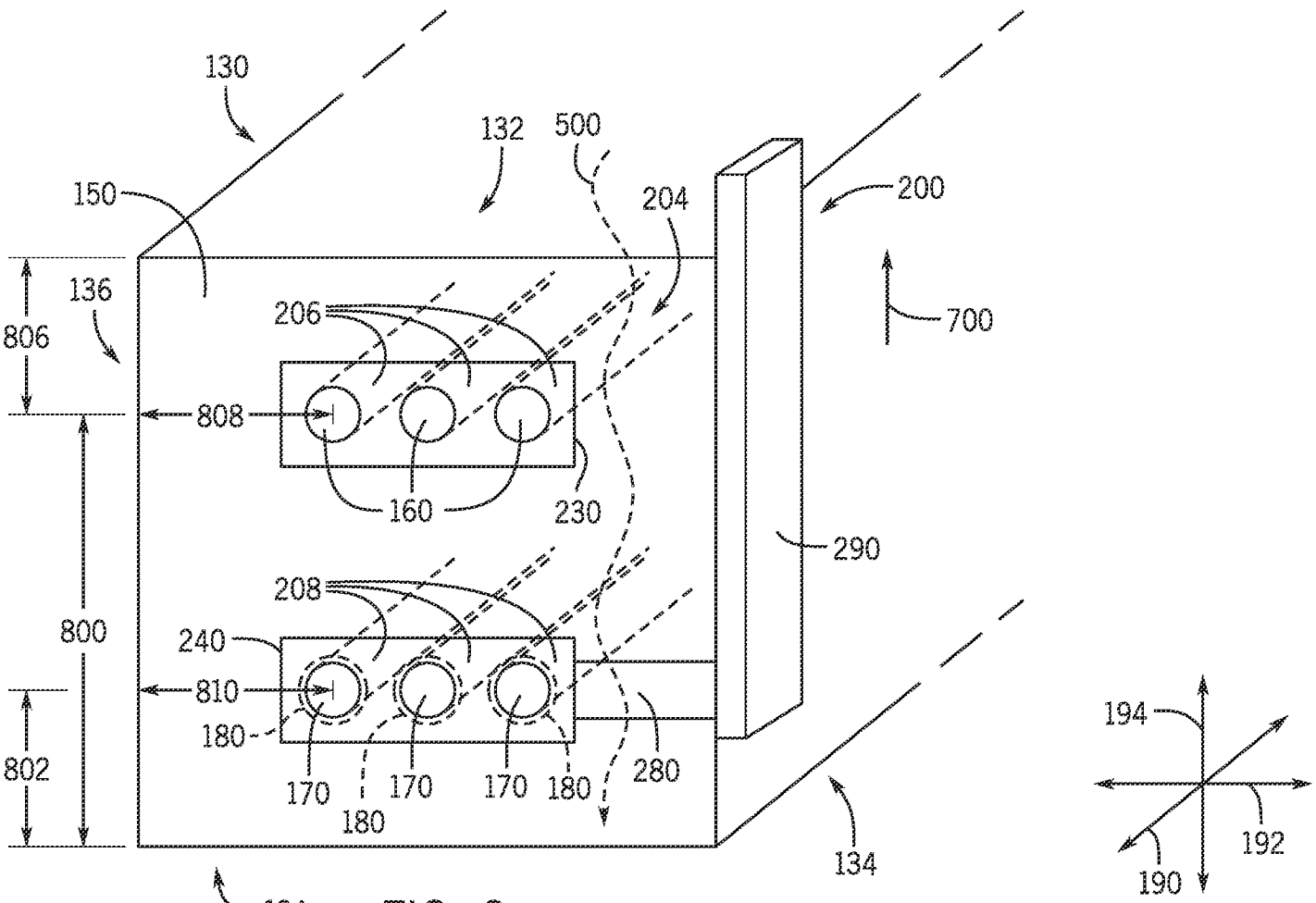
FIG. 9 is a front perspective view of an embodiment of a furnace, in accordance with an aspect of the present disclosure.

FIG. 9 is a front perspective view of an embodiment of the furnace 200, illustrating multiple heat exchange tubes 204 arranged along the longitudinal axis 192. As illustrated, each of the heat exchange tubes 204 includes the first port 206, which is fluidly coupled to the burner assembly 230 via respective inlets 160 (e.g., passage, channel, opening, aperture, hole) of the vestibule panel 150, and may also include the second port 208, which is fluidly coupled to the draft inducer 240 via respective outlets 170 (e.g., passage, channel, opening, aperture, hole) of the vestibule panel 150. As noted above, the burner assembly 230 may be coupled to the vestibule panel 150 above the draft inducer 240 relative to gravity (e.g., along the vertical axis 194). That is, the burner assembly 230 may be positioned above the draft inducer 240 such that the inlets 160 of the vestibule panel 150 are positioned above the outlets 170 of the vestibule panel 150 along the vertical axis 194. Further, in some embodiments, a respective inlet 160 and the corresponding outlet 170 (e.g., inlet and outlet fluidly coupled together via a heat exchange tube 204) are also aligned along the vertical axis 194 such that the first port 206 and the second port 208 of each respective heat exchange tube 204 are aligned with one another along the vertical axis 194. For example, the burner assembly 230 may be coupled to the vestibule panel 150 such that a respective inlet 160 (e.g., a first inlet) is positioned a distance 800 from the base 134 of the housing 130 and a distance 808 from a side 136 of the housing 130, and the draft inducer 240 may be coupled to the vestibule panel 150 such that a respective outlet 170 (e.g., a first outlet fluidly coupled to the first inlet 160 via a heat exchange tube 204) is positioned a distance 802 from the base 134 of the housing 130 and a distance 810 from the side 136 of the housing 130. The distance 800 may be greater than the distance 802, and the distance 808 may be approximately equal to the distance 810. Thus, each inlet 160 may be positioned within the vestibule panel 150 at a position above the corresponding outlet 170 relative to gravity such that the first port 206 of a respective heat exchange tube 204 is aligned with the corresponding second port 208 of the respective heat exchange tube 204 along the vertical axis.

As discussed above, the furnace 200 may be part of an outdoor or rooftop HVAC unit. In some embodiments, the burner assembly 230 may also be positioned within a threshold distance 806 from the first side 132 (e.g., top side) of the housing 130, thereby providing a desired clearance between the burner assembly 230 and the first side 132. For example, during a heating mode, the burner assembly 230 may be operated to generate combustion gases to heat an air flow. By positioning the burner assembly 230 near the first side 132 (e.g., within a threshold distance 806 from the first side 132), heat generated from the operation of the burner assembly 230 may melt snow accumulated on the first side 132 of the housing such that the snow may be directed away from the burner assembly 230 via gravity, thereby reducing undesirable effects on the structural integrity and/or performance of the components of the burner assembly 230 that may otherwise be caused by contact with water or other liquid.

In some embodiments, the exhaust outlet 280 of the draft inducer 240 may be fluidly coupled to the conduit 290, which may extend in the direction 700, such as along the vertical axis 194. As shown in the illustrated embodiment, the conduit 280 may extend in the direction 700 to a position above the first side 132 of the housing 130 (e.g., along the vertical axis 194). Directing the combustion products along the exhaust conduit 280 in the direction 700 may also facilitate reducing undesirable effects on the structural integrity and/or performance of the components of the furnace 200. For example, heat from the combustion products discharged via the conduit 290 may also be used to melt snow or other environmental conditions which may accumulate on the first side 132 of the housing 130 and may have an undesirable impact on the performance of the furnace 200 and/or may cause the furnace 200 to bear an undesired weight.

Figure 10:
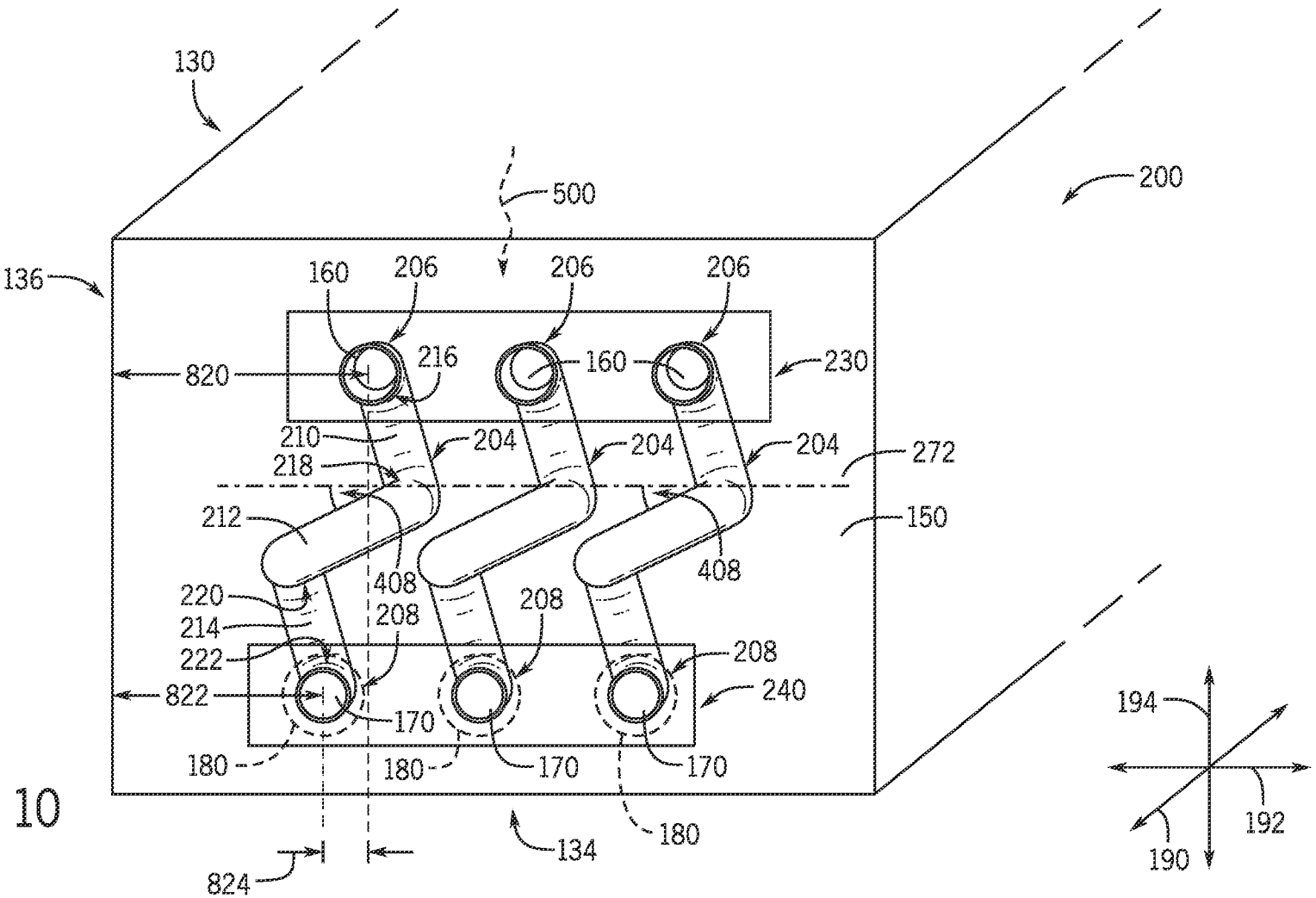
FIG. 10 is a front perspective view of an embodiment of a furnace, in accordance with an aspect of the present disclosure.

FIG. 10 is front perspective view of an embodiment of the furnace 200, illustrating multiple heat exchange tubes 204 arranged along the longitudinal axis 192. As described above with respect to FIG. 9, the respective inlets 160 may be positioned above the respective outlets 170 relative to gravity, and thus the first port 206 of each heat exchange tube 204 may also be positioned above the respective second port 208 relative to gravity. In some embodiments, the heat exchange tubes 204 may also be arranged such that the first port 206 is offset (e.g., horizontally offset) from the corresponding second port 208 of the heat exchange tube 204 along the longitudinal axis 192. For example, the burner assembly 230 may be coupled to the vestibule panel 150 such that a respective inlet 160 is positioned a distance 820 from the side 136 of the housing 130, and the draft inducer 240 may be coupled to the vestibule panel 150 such that the corresponding outlet 170 (e.g., outlet fluidly coupled to the respective inlet via the heat exchange tube 204) is positioned a distance 822 from the side 136 of the housing 130. The distance 820 is greater than the distance 822, such that the respective inlet 160 and the corresponding outlet 170 are offset (e.g., horizontally offset) from one another along the longitudinal axis 192 by a distance 824. Accordingly, when installed, a respective heat exchange tube 204 may include a first port 206 that couples to the inlet 160 at the distance 820 from the side 136 of the housing 130, and a second port 208 that couples to the outlet 170 at the distance 822 from the side 136 of the housing 130, and thus, the first port 206 and the corresponding second port 208 of the respective heat exchange tube 204 may also be offset from one another along the longitudinal axis 192 by the distance 824. In some embodiments, the distance 820 may be less than the distance 822.

In some embodiments, the respective inlets 160 and the corresponding outlets 170 may be offset from one another by the distance 824, and the burner assembly 230 and the draft inducer 240 may nevertheless be aligned with one another along the vertical axis 194. For example, the first port 206 of each heat exchange tube 204 may be fluidly coupled to a respective inlet 160, the second port 208 may be fluidly coupled to a respective outlet 170, and the heat exchange tubes 204 may each have a geometry or configuration that enables the first ports 206 and the corresponding second ports 208 to be offset from one another by the distance 824. By arranging the inlets 160, the outlets 170, and the heat exchange tubes 204 in different orientations (e.g., inlet 160 and outlet 170 aligned with one another along the vertical axis 194, inlet 160 and outlet 170 offset from one another relative to the longitudinal axis 194, first and second ports 206, 208 aligned with one another along the vertical axis 194, first and second ports 206, 208 offset from one another relative to the longitudinal axis 192), an overall size, height, and/or footprint of the furnace 200 may be reduced, thereby reducing costs associated with manufacture, operation, and/or maintenance of the furnace 200. For example, in the illustrated embodiment, the inlets 160 and corresponding outlets 170 are offset with one another relative to the longitudinal axis 192 (e.g., not aligned with one another along the vertical axis 194), which reduces an overall height occupied by the furnace 200.

As described above with respect to FIG. 7, each of the heat exchange tubes 204 may include two or more passes (e.g., passes 216, 218, 220, 222 of FIG. 7) and two or more bends (e.g., bends 210, 212, 214). In some embodiments, one or more of the bends 210, 212, 214 may generally extend from one pass to another pass along the longitudinal axis 192 and may be disposed at an angle relative to the horizontal axis 272 (e.g., a horizontal direction) such that liquid condensate formed within the heat exchange tube 204 may be directed away from the burner assembly 230 via gravity. For example, the bend 212 may generally extend along the longitudinal axis 192 from the second pass 218 to the third pass 220 and may be disposed at an angle 408 relative to the horizontal axis 272 such that the bend 212 extends cross-wise to a direction of the airflow 500 (e.g., downward direction). In other embodiments, one or more of the bends 210, 212, 214 may extend in a direction along the vertical axis 194. It should be noted that the heat exchange tubes 204 may each have a geometry or configuration that includes one or more bends that extend from one pass to another pass in a direction along the vertical axis 194, one or more bends that extend from one pass to another pass in a direction along the longitudinal axis 192 at an angle relative to the horizontal axis 272, one or more passes that extend in a direction along the lateral axis 190 (e.g., horizontal direction), one or more passes that extend in a direction along the lateral axis 190 at an angle relative to the horizontal axis 272, or any combination thereof.

As set forth above, the furnace of the present disclosure may provide one or more technical effects useful in the operation of HVAC systems, such as packaged HVAC units, configured to operate in a cooling mode and in a heating mode. For example, the furnace may be disposed within an air flow path of the HVAC system to enable the furnace to heat an air flow during operation of the furnace in the heating mode. During operation of the HVAC system in the cooling mode, relatively cool air may be directed across heat exchange tubes of the furnace, and air (e.g., ambient air) residing within the heat exchange tubes thereby be cooled. As a result, moisture within the air may condense and form liquid condensate within the heat exchange tubes. The top-fired burner assembly configuration disclosed herein enables discharge of the liquid condensate from the furnace while also mitigating contact between the liquid condensate and the burner assembly, thereby reducing adverse impacts on components of the HVAC system that may otherwise be caused by the liquid condensate. That is, the presently disclosed techniques may reduce a likelihood of wear and degradation to the HVAC system and its components that may be caused by water contact during operation of the HVAC system. The technical effects and technical problems in the specification are examples and are not limiting. It should be noted that the embodiments described in the specification may have other technical effects and can solve other technical problems.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace for a heating, ventilation, and air conditioning (HVAC) unit, comprising:

a heat exchange tube configured to flow combustion products therethrough and place the combustion products in a heat exchange relationship with an air flow directed across the heat exchange tube, wherein the heat exchange tube comprises a plurality of passes extending across a flow path of the air flow directed across the heat exchange tube;

a burner assembly fluidly coupled to a first port of the heat exchange tube and configured to generate the combustion products directed into the heat exchange tube via the first port;

a draft inducer blower fluidly coupled to a second port of the heat exchange tube and configured to draw the combustion products through the heat exchange tube, wherein the burner assembly is higher in position than the draft inducer blower relative to a base of the HVAC unit in an installed configuration of the furnace with the HVAC unit; and a paper gasket fluidly coupled to and disposed circumferentially around the second port and configured to receive condensate formed during operation of the furnace, wherein a material of the paper gasket is porous and is configured to enable the condensate to drain through the material in a vertical direction away from the draft inducer blower.

2. The furnace of claim 1, comprising a panel, wherein the heat exchange tube is secured to the panel and is disposed on a first side of the panel, and the burner assembly and the draft inducer blower are coupled to a second side of the panel.

3. The furnace of claim 2, wherein the paper gasket is disposed between the panel and the draft inducer blower.

4. The furnace of claim 2, wherein the first port of the heat exchange tube fluidly couples with the burner assembly via a first passage through the panel and the second port of the heat exchange tube fluidly couples with the draft inducer blower via a second passage in the panel.

5. The furnace of claim 4, wherein the first passage is vertically above and horizontally offset from the second passage.

6. The furnace of claim 1, wherein the draft inducer blower is configured to discharge the combustion products from the HVAC unit via a side panel of the HVAC unit in the installed configuration of the furnace with the HVAC unit.

7. The furnace of claim 1, comprising a conduit configured to receive the combustion products from the draft inducer blower and direct flow of the combustion products in an additional vertical direction.

8. The furnace of claim 7, wherein the conduit is configured to discharge the combustion products from the HVAC unit in the installed configuration of the furnace with the HVAC unit.

9. A furnace for a heating, ventilation, and air conditioning (HVAC) system, comprising:

a panel comprising an inlet and an outlet;

a heat exchange tube fluidly coupled to the inlet and to the outlet on a first side of the panel and configured to direct combustion products from the inlet to the outlet and place the combustion products in a heat exchange relationship with an air flow directed across the heat exchange tube along an air flow path through the furnace, wherein the heat exchange tube comprises a plurality of tube passes extending across the air flow path;

a burner assembly coupled to a second side of the panel at a first position along a vertical axis, wherein the burner assembly is configured to generate the combustion products and direct the combustion products into the heat exchange tube via the inlet;

a draft inducer blower coupled to the second side of the panel at a second position along the vertical axis, wherein the draft inducer blower is configured to draw the combustion products through the heat exchange tube towards the outlet, wherein the first position is above the second position along the vertical axis; and a paper gasket fluidly coupled to and disposed circumferentially around the outlet, wherein the furnace is configured to direct condensate formed in the heat exchange tube along the paper gasket, and wherein the paper gasket is configured to enable the condensate to drain therethrough.

10. The furnace of claim 9, wherein the heat exchange tube comprises a first port fluidly coupled to the burner assembly via the inlet, and the heat exchange tube comprises a second port fluidly coupled to the draft inducer blower via the outlet.

11. The furnace of claim 10, wherein the first port and the second port are aligned with one another along the vertical axis.

12. The furnace of claim 10, wherein the first port and the second port are horizontally offset from one another relative to the vertical axis.

13. The furnace of claim 9, wherein the paper gasket is configured to direct the condensate in a direction along the vertical axis of the furnace toward a drain conduit.

14. A furnace for a heating, ventilation, and air conditioning (HVAC) system, comprising:

a heat exchange tube comprising a first port configured to receive combustion products and a second port configured to discharge the combustion products, wherein the heat exchange tube comprises a plurality of tube passes extending across a flow path of an air flow directed across the heat exchange tube, and wherein the heat exchange tube is configured to direct the combustion products from the first port to the second port;

a burner assembly fluidly coupled to the first port, wherein the burner assembly is configured to generate the combustion products and direct the combustion products into the heat exchange tube via the first port;

a draft inducer blower fluidly coupled to the second port, wherein the draft inducer blower is configured to draw the combustion products through the heat exchange tube and remove the combustion products from the heat exchange tube via the second port, wherein the first port is above the second port relative to gravity, and wherein the heat exchange tube is configured to discharge liquid condensate from the heat exchange tube via the second port; and a paper gasket fluidly coupled to and disposed circumferentially around the second port, wherein the furnace is configured to direct liquid condensate formed in the heat exchange tube along the paper gasket, and wherein a material composition of a material of the paper gasket is configured to enable the liquid condensate to pass through the material and out of the paper gasket.

15. The furnace of claim 14, comprising a panel comprising a first passage and a second passage formed therein, wherein the heat exchange tube is secured to the panel and is disposed on a first side of the panel, the burner assembly and the draft inducer blower are coupled to a second side of the panel, the first port is fluidly coupled to the burner assembly via the first passage, and the second port is fluidly coupled to the draft inducer blower via the second passage.

16. The furnace of claim 15, wherein the paper gasket is disposed on the second side of the panel between the second passage and the draft inducer blower, and the furnace comprises an exhaust conduit fluidly coupled to the draft inducer blower, wherein the exhaust conduit is configured to discharge the combustion products from the furnace.

17. The furnace of claim 1, wherein the plurality of passes is configured to direct the combustion products from the first port to the second port.

18. The furnace of claim 9, wherein each tube pass of the plurality of tube passes extends across the air flow path at a non-zero angle relative to a horizontal plane, and wherein the non-zero angle is a downward angle.

19. The furnace of claim 14, wherein the material composition of the material of the paper gasket is configured to enable the liquid condensate to drain through the paper gasket in a vertical direction away from the draft inducer blower.

20. The furnace of claim 1, wherein each pass of the plurality of passes extends across the flow path at a downward angle relative to a horizontal direction.

* * * * *